US007628052B2

(12) United States Patent
Zhang

(10) Patent No.: US 7,628,052 B2
(45) Date of Patent: Dec. 8, 2009

(54) HAND CRIMPING TOOL INTERCHANGEABLE AND INTERACTIVE JAWS

(75) Inventor: Hanzhen Zhang, Tianjin (CN)

(73) Assignee: Tianjin Runshi Science Development Co., Ltd., Beichen District, Tianjin (CN)

( * ) Notice: Subject to any disclaimer, the term of this patent is extended or adjusted under 35 U.S.C. 154(b) by 305 days.

(21) Appl. No.: 11/811,526

(22) Filed: Jun. 10, 2007

(65) Prior Publication Data

US 2008/0302165 A1 Dec. 11, 2008

(51) Int. Cl.
*B21D 37/14* (2006.01)
*B21D 37/02* (2006.01)

(52) U.S. Cl. ..... 72/409.16; 72/413

(58) Field of Classification Search ..... 72/409.01, 72/409.11, 409.16, 409.19, 413, 415, 416, 72/478–480, 481.1, 482.91; 81/177.2, 319, 81/320, 324, 331, 332

See application file for complete search history.

(56) References Cited

U.S. PATENT DOCUMENTS 2,746,327 A * 5/1956 Runde ..... 72/409.16
6,959,629 B2 * 11/2005 Hsien ..... 81/177.2

* cited by examiner

*Primary Examiner*—Dana Ross
*Assistant Examiner*—Teresa M Bonk

(57) ABSTRACT

A multi-functional crimping tool for connecting pipe joints with pipes is disclosed, the tool includes a pair of crimping head hinged together, form a circle cavity for penetrating the pipe, and at least a capped screw rotatably mounted onto a top side of the crimping head body and shifted from a fastening position and a releasing position; a pair of crimping jaws respectively and operatively clipped onto the crimping heads respectively, wherein in the fastening position, the capped screw is screwed down to secure the crimping jaws attach onto said crimping heads, and in the releasing position, the capped screw is loosened up allowing the crimping jaws transversely pulled off the crimping head for convenient replacement.

15 Claims, 13 Drawing Sheets

HAND CRIMPING TOOL INTERCHANGEABLE AND INTERACTIVE JAWS

BACKGROUND OF THE PRESENT INVENTION

1. Field of Invention

The present invention generally relates to a kind of crimping tool for pipe coupling, and more particularly, relates to a kind of universal crimping tool equipped with interchanged and interactive jaws for tightening resilient rings on to the pipe ends with a leak-proof manner and comparatively enhanced power.

2. Description of Related Arts

PEX and PAP pipes are widely applied to supply water, oil and gas, the diameters of the pipes generally are produced with elongated shape and categorized into standard sizes, such as ⅜-inch, ½-inch, ⅝-inch, ¾-inch and 1-inch. In most cases, a plurality of pipes would be coupled to form a variety of manifolds. Therefore, the pipes have to be cut into different sectional parts and then assembled together by metal insert fittings. Presently, metal insert fittings and tee fittings are most common parts in the market. A regular procedure for coupling PEX or PAP pipes is respectively inserting the ends of the pipe into corresponding openings of the pipe fittings for assembling the manifold or extended pipe. The immediate following step is providing a couple of resilient rings onto the coupling portion of the pipe fittings and rigidly crimping such resilient rings so as to deform such resilient rings for securing the coupling portion of the pipe fittings.

A conventional crimping tool generally comprises a pair of heads, a pair of crimping jaws provided onto the heads respectively, and a pair of handles for folding the jaws. There are circular though holes formed on the protruding portion of the crimping jaws respectively so as to accommodate to a screw for fastening the jaws to the heads. Unfortunately, a big hassle for users is that different pipe coupling process would require varied crimping jaws. That is, crimping jaws would be replaced from time to time in practices. When replacing a crimping jaw, the user would not remove the crimping jaws until he had completely loosened up the screw and taken it out from the circular though-hole. Moreover, there is no adjusting unit provided with a conventional crimping tool. Meanwhile, the handles and heads are connected together by screws, and the heads interconnected with each other also by screw or pin. During the operating process, such screws or pins would more or less squeeze the screw holes under a repetitiously applied external force, which leads to an extra space left between the screws and the screw holes. As a consequence, the crimping jaws would not be easily and fittingly attached onto the heads for tightening up the sealing rings. As a result, the pipe ends would not be received within the pipe joints in a leak-proof manner. In addition, there are always no cooperative tooth provided on both of the crimping jaws, such that it can not make sure that the crimping jaws evenly exert force on the sealing rings, that is, the sealing rings can not be evenly transformed, especially the portions clung to the combine position of the two crimping jaws always produce protruding portions. As a result, the sealing rings can not tightly couple the pipes in a leak-proof manner.

On the other hand, the length of the folding handles is not designed with an adjustable length. It is imaginable that a user will be harsh condition to crimp a pipe having a larger diameter. The crimping tool is prone to be damaged if the folding handles are short. In addition, since there is no protective sleeves sleeved onto the folding handles, handling such crimping tools would be painful to user's hands.

Accordingly, in order to overcome the above drawbacks of conventional crimping tools, it is highly encouraged to develop a kind of multi-functional crimping tool equipped with replaceable crimping jaws and adjustable folding handles

SUMMARY OF THE PRESENT INVENTION

A main object of the present invention is to provide a multi-functional crimping tool, wherein the interchangeable crimping jaws are conveniently removed from the heads of the crimping tool for facilitating the operation efficiency.

Another object of the present invention is to provide a multi-functional crimping tool comprising adjustable handles adapted for adjusting the length of the handles as required, such that the crimping tool can be energy efficient.

Another object of the present invention is to provide a multi-functional crimping tool comprising an adjusting unit provided for compensating the worn error between screws and screw holes after a period of use.

Another object of the present invention is to provide a multi-functional crimping tool comprising a pair of adjustable sleeves sheathed onto the upper arms for easy maneuverability.

Accordingly, in order to accomplish the above objects, the present invention provides a multi-functional crimping tool for connecting pipe joints with pipes, comprising:

a crimping head, which comprises a pair of crimping head, namely a first crimping head and a second crimping head, hinged together, wherein each of the crimping head has a crimping head body, inwardly curved to form a semi-circular cavity, at least a capped screw rotatably mounted onto a top side of the crimping head body at a position symmetrical with respect to other crimping head, and shifted from a fastening position and a releasing position;

a pair of crimping jaws respectively received within the semi-circular cavity and operatively clipped onto the crimping heads, wherein in the fastening position, the capped screw is screwed down to secure the crimping jaws attach onto the crimping heads, and in the releasing position, the capped screw is loosened up allowing the crimping jaws transversely pulled off the crimping head; and a pair of crimping handles respectively and pivotally connected with the crimping head, and folded towards and away with each other so as to facilitate the two crimping head moved towards with each to combine the two semi-circular cavity into a circular shaped cavity for accommodating the pipe, or moved away with each other for allowing the crimping jaws detachably attached onto the crimping heads respectively.

These and other objectives, features, and advantages of the present invention will become apparent from the following detailed description, the accompanying drawings, and the appended claims.

DETAILED DESCRIPTION OF THE PREFERRED EMBODIMENT

Figure 1:
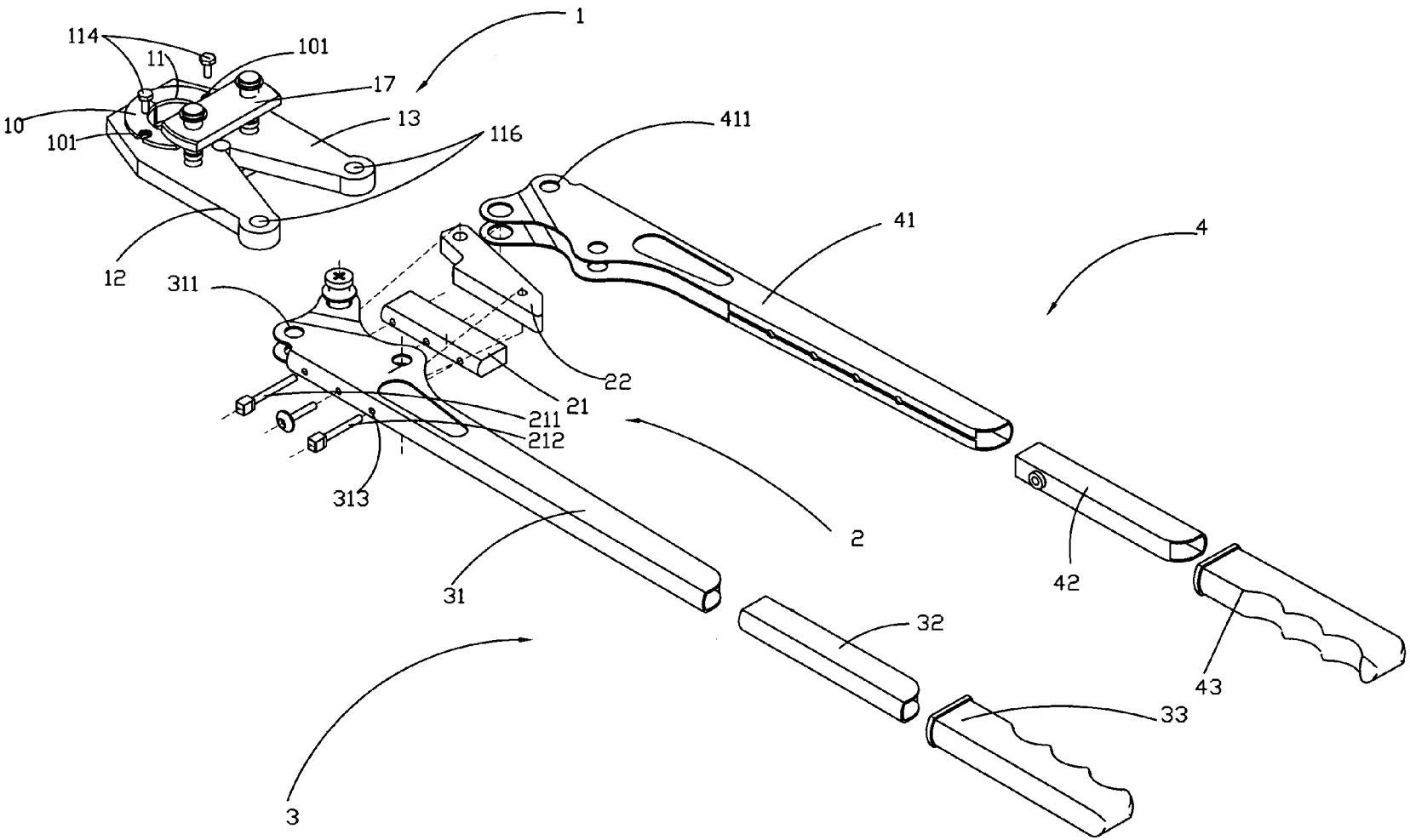
FIG. 1 is an exploded perspective view of a multi-functional crimping tool according to a preferred embodiment of the present invention.
Figure 2:
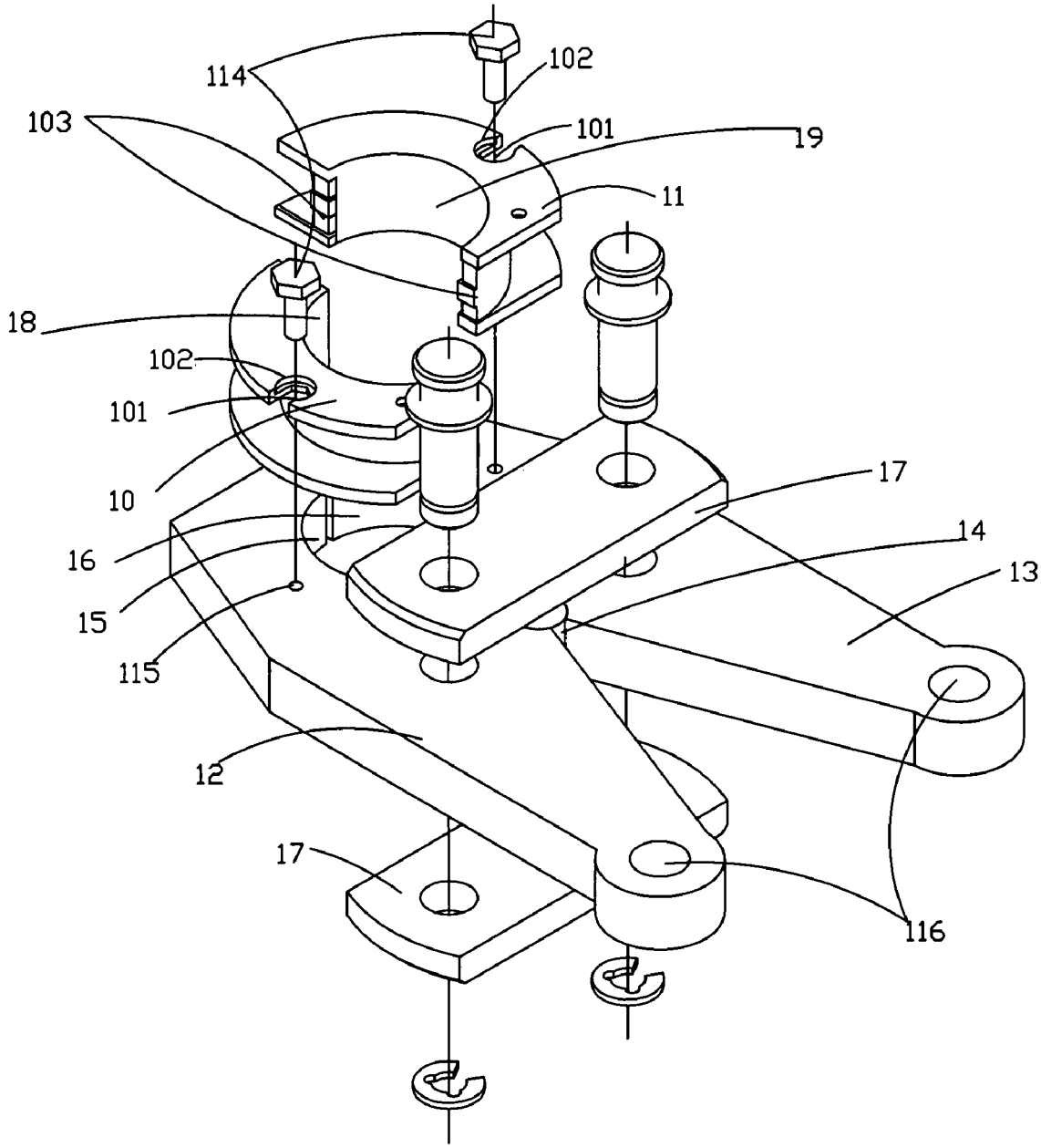
FIG. 2 is an exploded perspective view of the upper portion of the crimping tool according to the above preferred embodiment of the present invention.
Figure 3A:
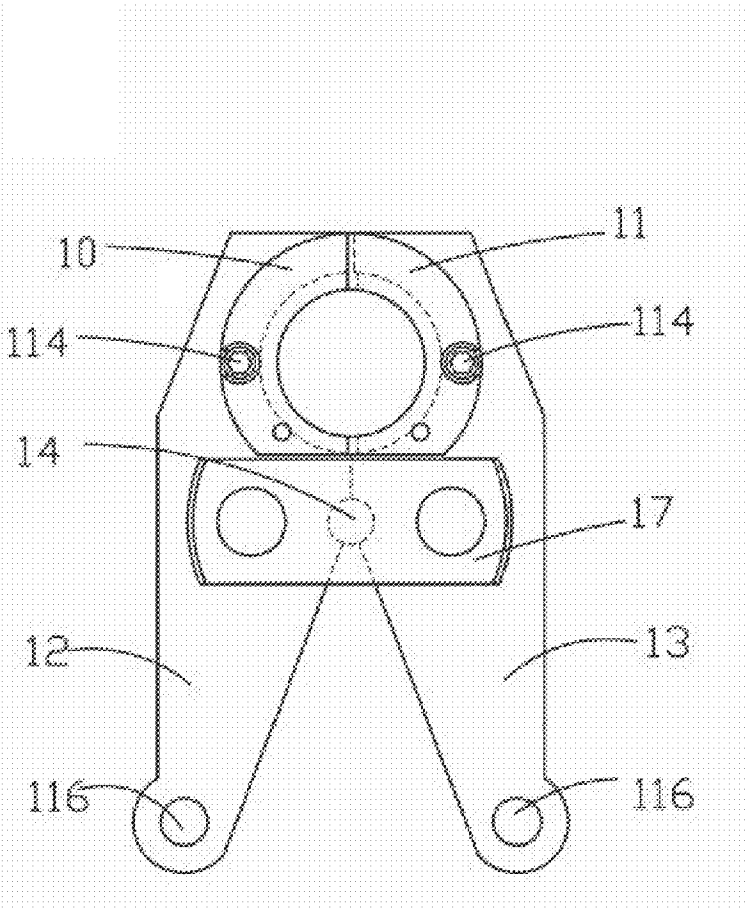
FIG. 3A is a top view of the upper portion according to the above preferred embodiment of the present invention, wherein the FIG. 3A illustrates the closed schematic view of the crimping head.
Figure 3B:
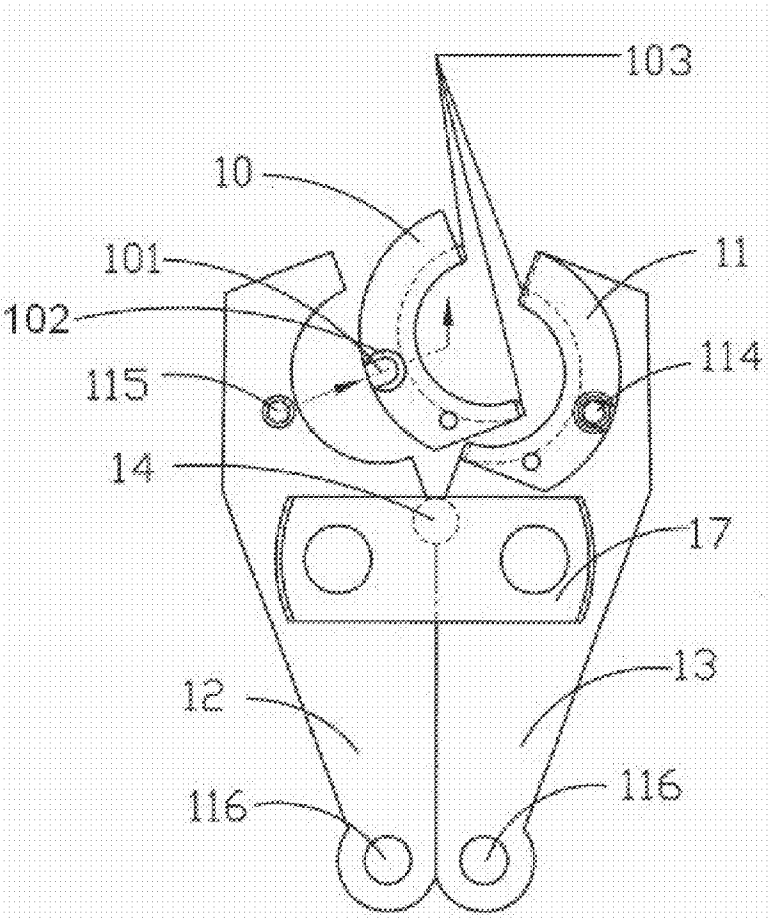
FIG. 3B is a top view of the upper portion according to the above preferred embodiment of the present invention, wherein the FIG. 3A illustrates the opened schematic view of the crimping head.
Figure 3C:
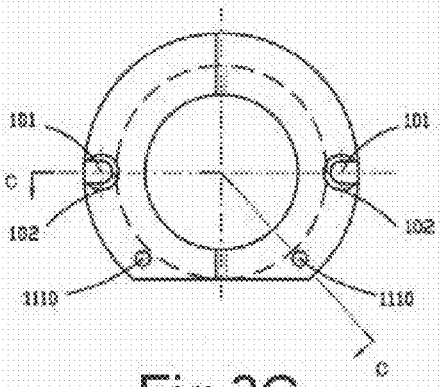
FIG. 3C is a top view of the closed crimping jaws according to the above preferred embodiment of the present invention.
Figure 3D:
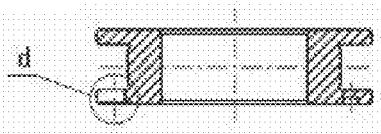
FIG. 3D is a c-c sectional view of FIG. 3B of the closed crimping jaws according to the above preferred embodiment of the present invention.
Figure 3E:
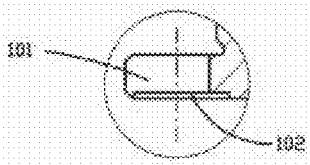
FIG. 3E is a zoomed-in view of the accurately shaped breach according to the above preferred embodiment of the present invention.
Figure 3F:
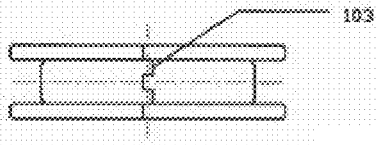
FIG. 3F is a zoomed-in view illustrating the two crimping jaws with cooperative tooth combined with each other according to the above preferred embodiment of the present invention.
Figure 3G:
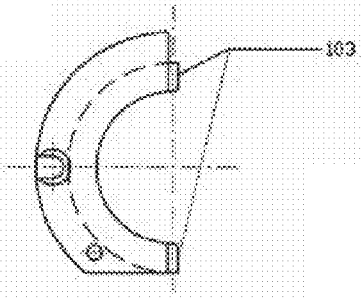
FIG. 3G is a top view of one crimping jaw with cooperative tooth according to the above preferred embodiment of the present invention.

Referring to FIGS. 1 and 2 of the drawings, a multi-functional crimping tool according to a preferred embodiment of the present invention is illustrated. The multi-functional crimping tool of the preset invention is adapted for connecting pipe joints with pipes in practice, and more particularly, is adapted to tighten up the sealing rings on the sleeve portion of the pipes.

The multi-functional crimping tool has an upper portion 1, wherein the upper portion 1 comprises a pair of crimping heads 12, 13, namely a first crimping head 12 and a second crimping head 13, hinged with each others. Furthermore, each of the crimping heads 12, 13 has a head body, inwardly curved to form a semi-circular cavity 15, 16, and at least a capped screw 114 rotatably mounted onto a top side of the head body at a position symmetrical with respect to other crimping head, and shifted from a fastening position and a releasing position.

The multi-functional crimping tool further comprises a pair of crimping jaws 10, 11 respectively received within the semi-circular cavity 15, 16 and operatively clipped onto the crimping heads 12 and 13, wherein in the fastening position, the capped screw 114 is screwed down to secure the crimping jaws 10 and 11 attach onto the crimping heads 12 and 13, and in the releasing position, the capped screw 114 is loosened up allowing the crimping jaws 10, 11 transversely pulled off the crimping head 12, 13.

As shown is FIG. 2, two crimping jaws 10, 11, and two crimping heads 12, 13 are illustrated, wherein the first crimping head 12 and the second crimping head 13 are operatively connected together through a positioning shaft 14 for ensuring the two crimping head 12, 13 moving towards or away from each other. Moreover, there are two reinforcement panels 17 spanned across two crimping head 12, 13 for respectively covering the top and bottom side of the positioning shaft 14. Each of the crimping jaws 10, 11 has an inner operative portion shaped as an inverted curve for forming two jaw cavities 18, 19 As a result, whenever the two crimping head 12, 13 are folded to move towards with each other, the two jaw cavities 18, 19 are capable of forming a circular shaped cavity so as to accommodate a pipe penetrated there through. According to the preferred embodiment of the present invention, each of the crimping jaws 10, 11 is adapted to be fitly received within the dies cavities 18, 19 with a conveniently removable manner.

Referring to FIG. 1 again, the multi-functional crimping tool of the present invention also comprises a pair of crimping handles 3, 4 respectively and pivotally connected with the crimping head 12, 13, and folded towards and away with each other so as to facilitate the two crimping head 12, 13 with the crimping jaws 10,11 moved towards with each to combine the two semi-circular cavities 18,19 into a circular shaped cavity for accommodating the pipes, or moved away with each other for allowing the crimping jaws 10, 11 detachably attached onto the crimping head 12, 13.

In other words, the multi-functional crimping tool of the present invention has an upper portion 1 consisted of a first crimping head 12 and a second crimping head 13 pivotally connected together thereto. And a pair of crimping jaws 10, 11 is respectively and replaceably attached onto the first crimping head 12 and the second crimping head 13 for a movement toward and away from each other.

The multi-functional crimping tool further comprises a pair of crimping handles 3, 4 pivotally connected with the crimping heads 12, 13 respectively, wherein the crimping handles 3, 4 respectively comprises an elongated upper arm 31, 41 pivotally connected with the crimping heads 12, 13 respectively, i.e. the first head 12 and the second head 13. A length adjusting arrangement 61 slidably engaged with the elongated arm 31, 41 respectively for adjusting a length of the crimping handle 3, 4.

Meanwhile, the multi-functional crimping tool further comprises an adjusting unit 2 operatively connected to one of the crimping handle 3, 4 for compensating a worn-error between the screws and the screw holes, wherein the adjusting unit 2 comprises a locating block 21 disposed within one of the crimping handles 3, 4, and an adjusting block 22 pivotally connected to both crimping handles 3, 4.

Referring to FIG. 2 of the drawings, it is seen that each of the crimping jaws 10, 11 is correspondingly shaped as a semi-circle body for matching with the semi-circular cavity 15, 16 of the crimping head 12, 13. It is noted that each of the crimping jaws 10, 11 has an upper flange and a lower flange rearwardly extended from the semi-circle body for defining a semi-circle shaped channel. Therefore, the inner operative portion of the crimping head 12, 13 is capable of being pushed into the semi-circle shaped channel in practices.

According to the preferred embodiment of the present invention, the upper flanges of the crimping jaws 10, 11 further has a positioning notch 101 defined thereon for inserting the screws 114. Each of the positioning notches 101 is defined with a T-shaped cross section, wherein the upper portion of the positioning notches 101 is functioned as a recessed terrace 102 for perching a screw cap. Accordingly, the upper recessed terrace 102 is interactive for matching the common screw nut-cap. That is, whenever the semi-circular shaped crimping jaws 10, 11, each of which having an upper flange and a lower flange, is clipped onto the crimping head 12, 13, the upper flange of the crimping jaws 10, 11, would be biasing onto the top surface of the crimping head 12, 13. The preformed notch 101 would leave a T-shaped channel on the crimping jaws 10, 11 for penetrating a capped screw 114 into the crimping heads 12, 13. Due to the fact that the recessed terrace 102 is hex-shaped, the screw 114 will be blocked from transversely slipped out from positioning notch 101.

In other words, the capped screw 114 is permanently provided onto the crimping head 12, 13, and the crimping jaws 10,11 of the present invention is provided with a positioning notch 101 for clicking onto the capped screw 114. In the fastening position, the screw cap of the screw 114 is screwed down perching onto the recessed terrace 102, it is impossible to pull off the crimping jaws 10, 11. Otherwise, the crimping jaws 10, 11 are capable of transversely slipped out from the crimping head 12, 13.

Compared with conventional design, the structure of the present invention would save the attaching/detaching time of the crimping jaws 10, 11. In the present invention, the user is no more required to completely remove the screw 114 from the crimping heads 12, 13. Instead, he or she can merely loosen up the screw 114 a little bit enabling the screw cap of the screw 114 disengaged with the recess terrace 102 first, and then transversely pull the crimping jaws 10, 11 from the crimping head body for necessary replacement. Meanwhile, the capped screw 114 is still attached onto the crimping head 12, 13. Accordingly, whenever a user is willing to attach a new crimping jaws, he or she just needs to align the notch 101 of the crimping jaws 10, 11 with the screw 114 first, and then push the crimping jaws 10, 11 to completely clip onto the crimping head 12, 13, and finally tighten up the screw 114 until the screw cap well received within the recess terrace 102.

In addition, there is a plurality of engaging teeth 103 provided on both of the crimping jaws 10, 11, wherein the engaging teeth 103 can be defined as a notch spacedly and evenly formed along the front protruded portions of the crimping jaws 10, 11. The engaging teeth 103 provided on the crimping jaws 10, 11 are evenly staggered, that is, one engaging tooth is tightly engaged with a notch. Depending on such engaging tooth 103, the crimping jaws 10, 11 can be tightly engaged with each other in a biting manner. Therefore, the crimping jaws 10, 11 can evenly exert force on the sealing ring to couple the pipes in a leak-proof manner. Moreover, because the sealing rings are evenly transformed, it makes the pipe couplings look good.

It is noted that a pair of holes 115 are respectively provided on the top surface of the crimping head 12, 13 for receiving the capped screws 114. Also, the size of the recessed terrace 102 of the notch 101 is slightly larger than the dimension of the screw cap of the screw 114, such that the screw caps of the screws 114 can tightly press onto the recessed terrace 102.

In addition, each of the first and second crimping head 12, 13 respectively has a screw hole 116 on the lower portion thereof for pivotally coupling the crimping handles 3, 4.

Figure 4:
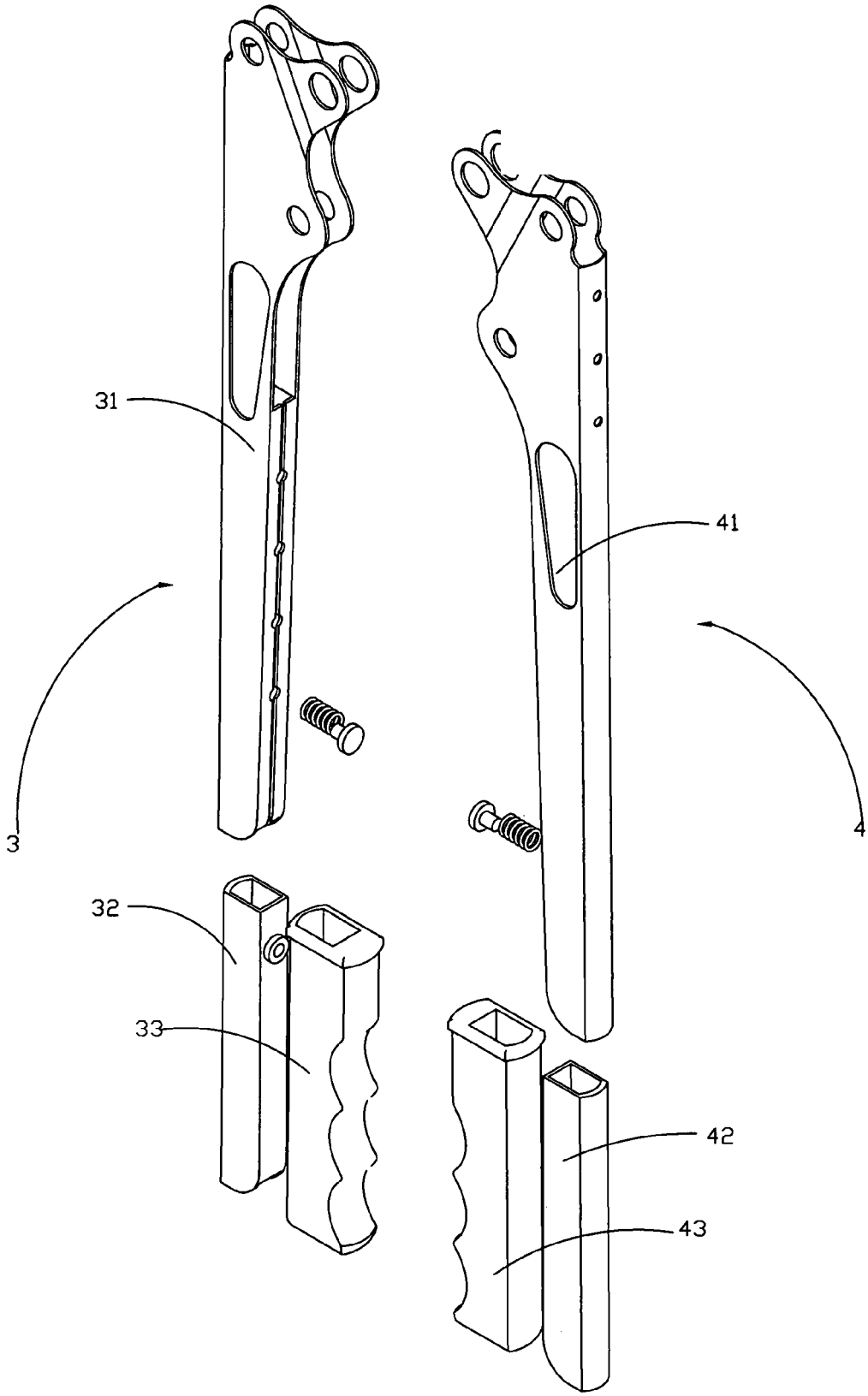
FIG. 4 is an exploded perspective view of the adjustable handles according to the above preferred embodiment of the present invention.

Referring to FIG. 4 of the drawings, two crimping handles 3, 4 are pivotally connected through a screw. The crimping handles 3, 4 comprises an elongated upper arm 31, 41 respectively, and a lower sleeves 32, 42 slidably engaged with the upper arm 31, 41 respectively for selectively managing a length of the crimping handles 3, 4. It is noted that the upper arm 31, 41 are respectively and pivotally connected with the first and second crimping head 12, 13.

Figure 5:
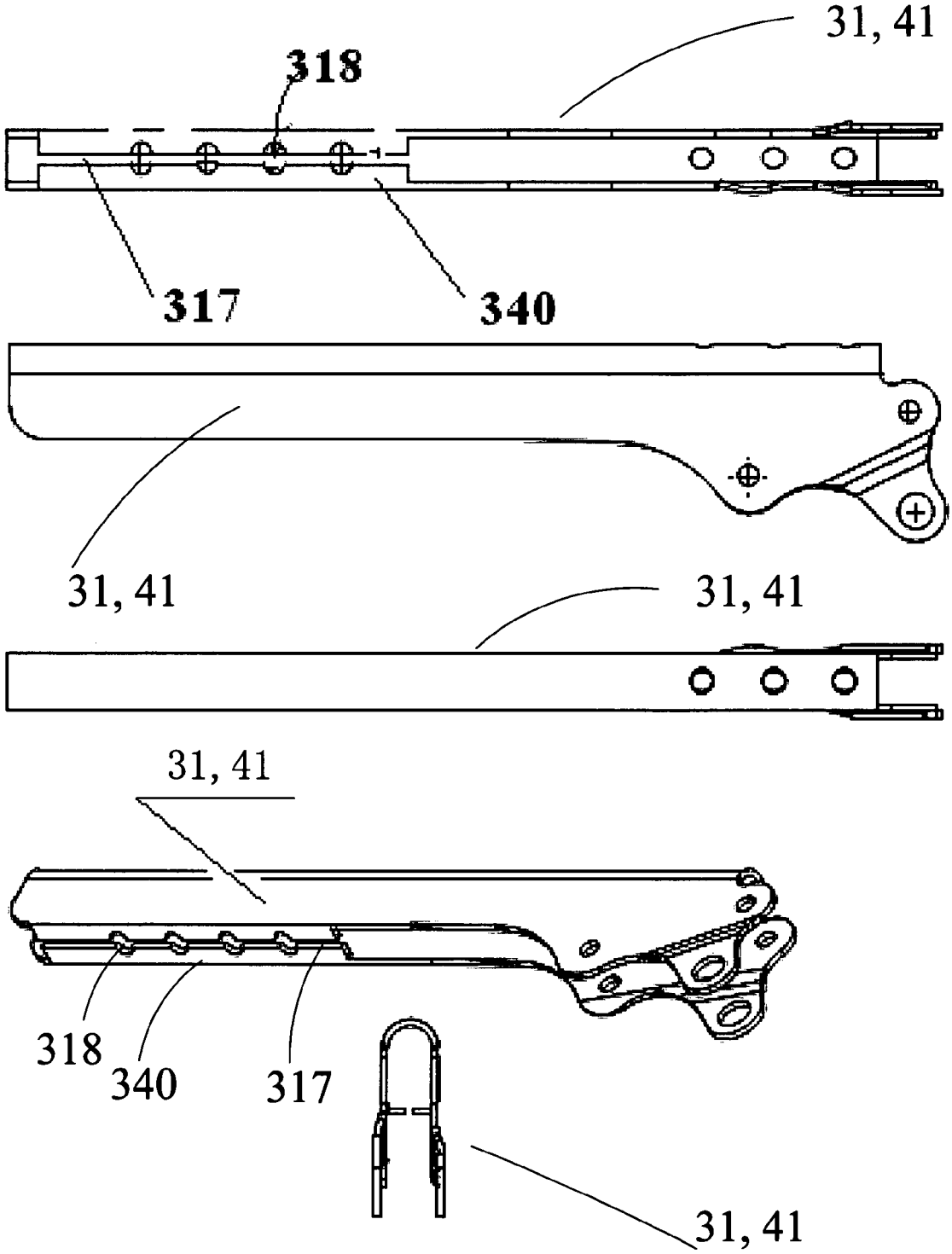
FIG. 5 illustrates a perspective view, all directions of side views of the upper arms according to the above preferred embodiment of the present invention.

Referring to FIG. 5 of the drawings, the upper arms 31, 41 are prepared with an elongated shaped body having two longitudinal ridges 340 inwardly tucked at a lower portion of the upper arms 31, 41 to form an elongated guiding channel 317.

The guiding channel 317 is adapted for guiding the lower sleeves 32, 42 being inserted into the upper arm 31, 41. What is more, the two longitudinal ridges 340 of the upper arm 31, 41 further have a plurality of positioning slots 318 spacedly and evenly defined on both edges of the elongated guiding channel 317 with a predetermined interval so as to form a plurality of positioning slots 318.

Figure 6:
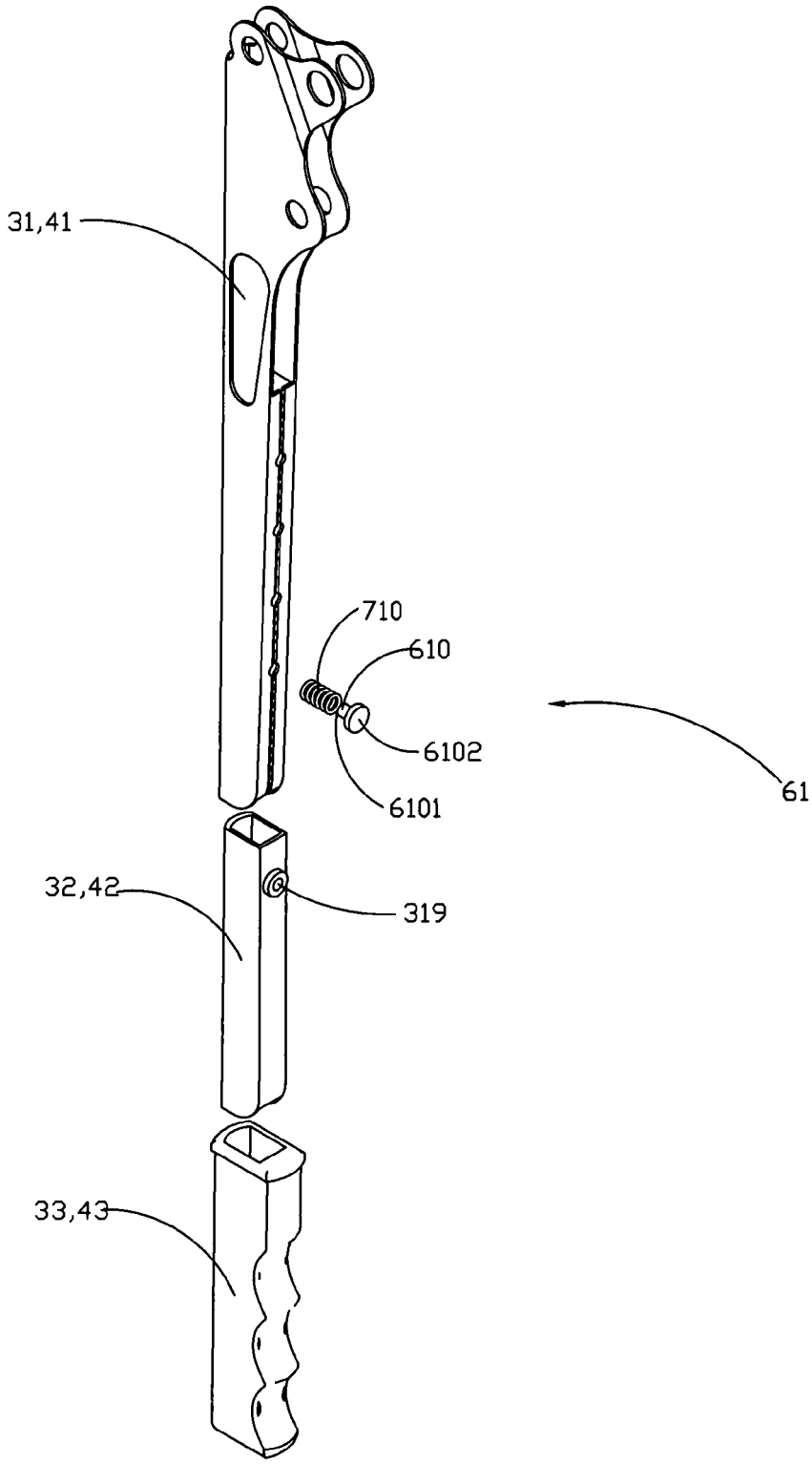
FIG. 6 is an exploded schematic view of the adjustable handles according to the above preferred embodiment of the present invention

As shown in FIG. 6, the crimping handles 3, 4 of the present invention further comprise a length adjusting arrangement 61 provided within the lower sleeves 32, 42 respectively for selectively adjusting the length of the crimping handle 3, 4.

Figure 7:
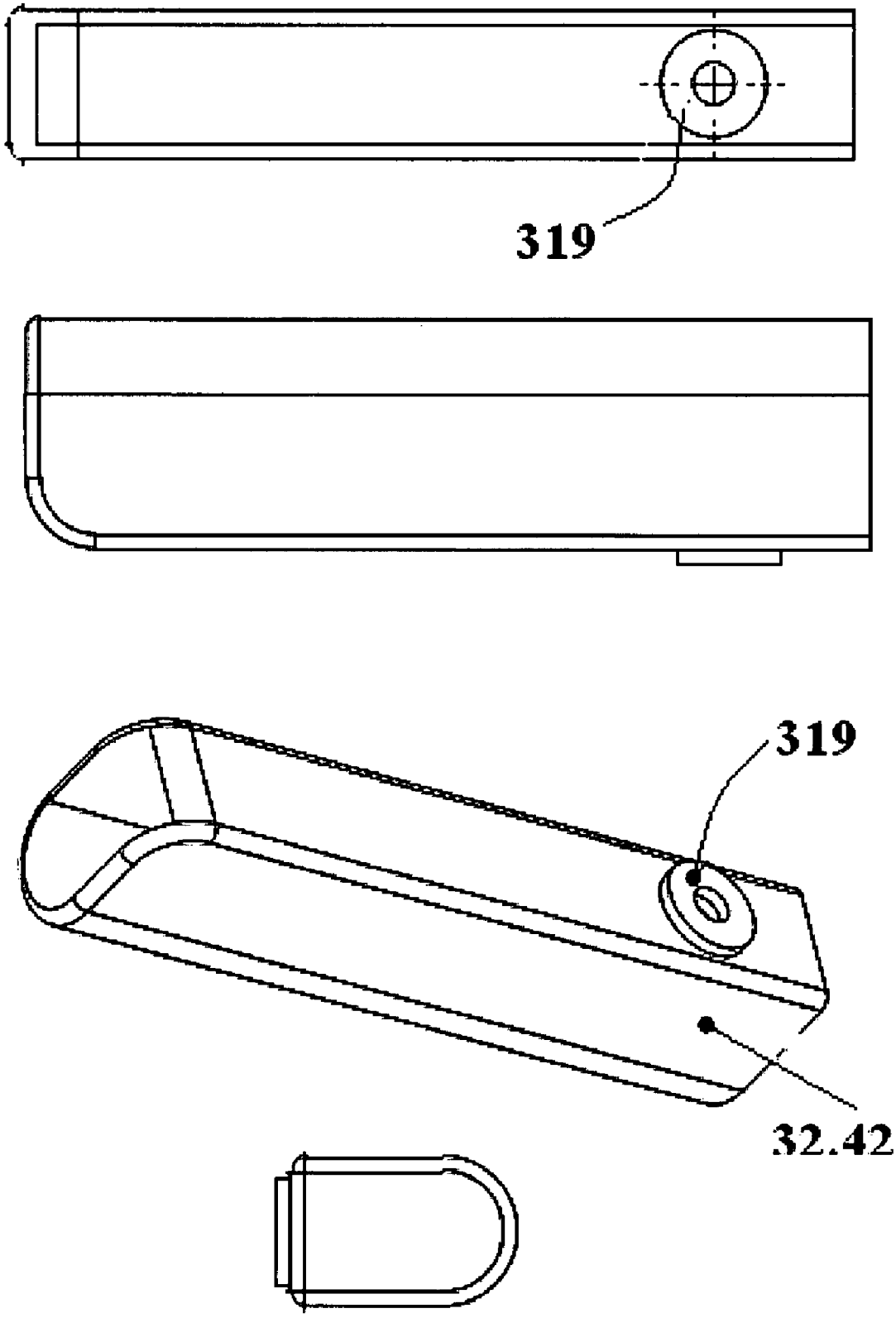
FIG. 7 illustrates a perspective view, all directions of side views of the added arms according to the above preferred embodiment of the present invention.

As shown in FIG. 7, the lower sleeves 32, 42 are shaped in compliance with that of the upper arms 31, 41, wherein each of the lower sleeves 32, 42 has an opening at one end for fittingly being inserted into the lower portion of the upper arms 31, 41 respectively.

Each of the lower sleeves 32, 42 further comprises a protruding knob 319 projected from the lower sleeves 32, respectively for accommodating to and positioning the length adjusting arrangement 61.

Referring to FIGS. 6 and 7 of the drawings, the length adjusting arrangement 61 comprises an adjusting button 610 having a push end 6102 provided onto the protruding knob 319, and a resilient end biasing against the inner wall of the lower sleeves 32, 42. It is noted that such adjusting button 610 is transversely crossed into the inner cavity of lower sleeves 32, 42 through the adjusting knob 319. The adjusting button 610 further comprises a positioning valve 6101 provided on its shaft at a predetermined position. The length adjusting arrangement 61 is operated with such a manner that when the push end of the adjusting button 610 is depressed, the positioning valve 6101 will be lower to a position below the edge guiding channel 317 of the upper arms 31, 41 so as to allow the lower sleeves 32, 42 freely slide with respect to the upper arms 31, 41 until the adjusting button 610 meet the next positioning slot 318 of the guiding channel 317.

In order to fasten the adjusting button 610 to the upper arms 31, 41, the guiding channel 317 should be slightly larger than the diameter of the adjusting button 610, such that the adjusting button 610 can be inserted into the guiding channel 317. While the positioning slots 318 should be slightly larger than the size of the positioning valve 6101 adjusting button 320 in such manner the positioning valve 6101 could be smoothly slide into the positioning slots 318.

Referring to FIG. 4 of the drawings again, the crimping handles 3, 4 further comprises a pair of protection sleeves 33, 43 coupled with the lower sleeves 32, 42 respectively, not only for extending the crimping handles 3, 4, but also for adding a protective layer so as to ease users' hands.

Accordingly, the installation of the adjusting arrangement 61 generally comprises several steps. Firstly, the lower sleeves 32, 42 are inserted into the protection sleeves 33, 43 respectively, wherein the protruding knob 319 having a through hole therein matched with the corresponding opening formed on the protection sleeves 33, 43. Secondly, the adjusting buttons 610 equipped with the resilient means 710 are mounted onto the lower sleeves 32, 42 respectively through the protruding knob 319. Preferably, the resilient means is embodied as a coil spring, wherein one end of the resilient element 710 is against the protruding knob 319, and the other end of the resilient element 710 is against the inner wall of the push end 6102 of the adjusting button 6101. Thirdly, the stem of the adjusting button 610 is slidably inserted into the guiding channel 317. In addition, the positioning valve 6101 of the adjusting button 610 will automatically slides into the positioning slot 318 depending on the force exerted by the resilient means 710. When the crimping tool is adapted for dealing with certain pipe couplings with varied diameter, the user is able to extend out the crimping handle 3, 4 or draw back the crimping handles 3, 4 to achieve an optimized force torque.

Figure 8:
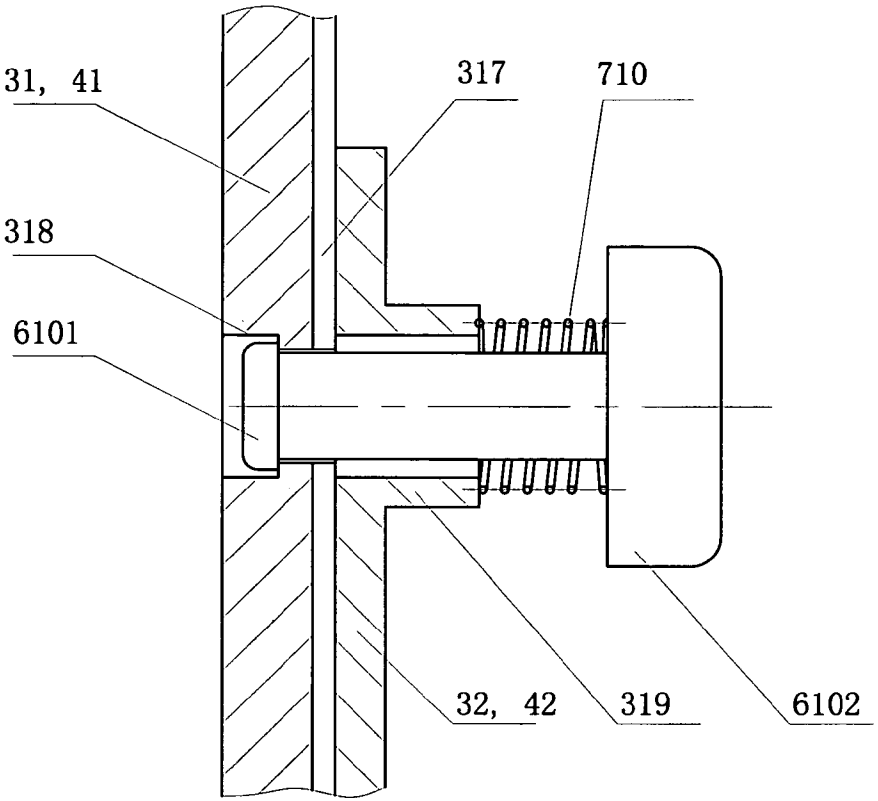
FIG. 8 is a sectional view of the adjustable handles mounted with a length adjusting arrangement according to the above preferred embodiment of the present invention.

Referring to FIG. 8 of the drawings, it is a sectional view of the assembled adjustable handles 3, 4, wherein the adjusting arrangement 61 have been installed to the lower sleeves 32, 42 according to the above-mentioned installation steps.

Figure 9:
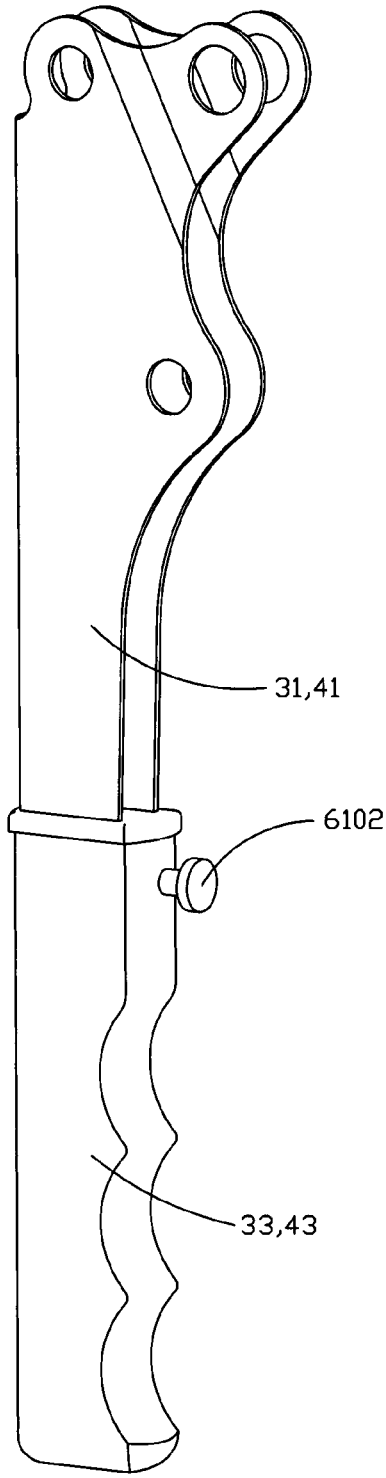
FIG. 9 is an assembled perspective view of the adjustable handles according to the above preferred embodiment of the present invention.

Referring to FIG. 9 of the drawings, it is a perspective view of the assembled adjustable handles 3, 4, wherein the adjusting arrangement 61 have been installed to the lower sleeves 32, 42 according to the above-mentioned installation steps.

According to the following steps, the user can adjust the length of the adjustable handles 3, 4. Firstly, press the adjusting button 610 until the positioning valve 6101 of the adjusting button 610 disengaged from the positioning slot 318; Secondly, longitudinally shift the protection sleeves 33, 43 with respect to the upper arms 31, 41 until a desired length of the adjustable handles 3, 4 is achieved.

Figure 10:
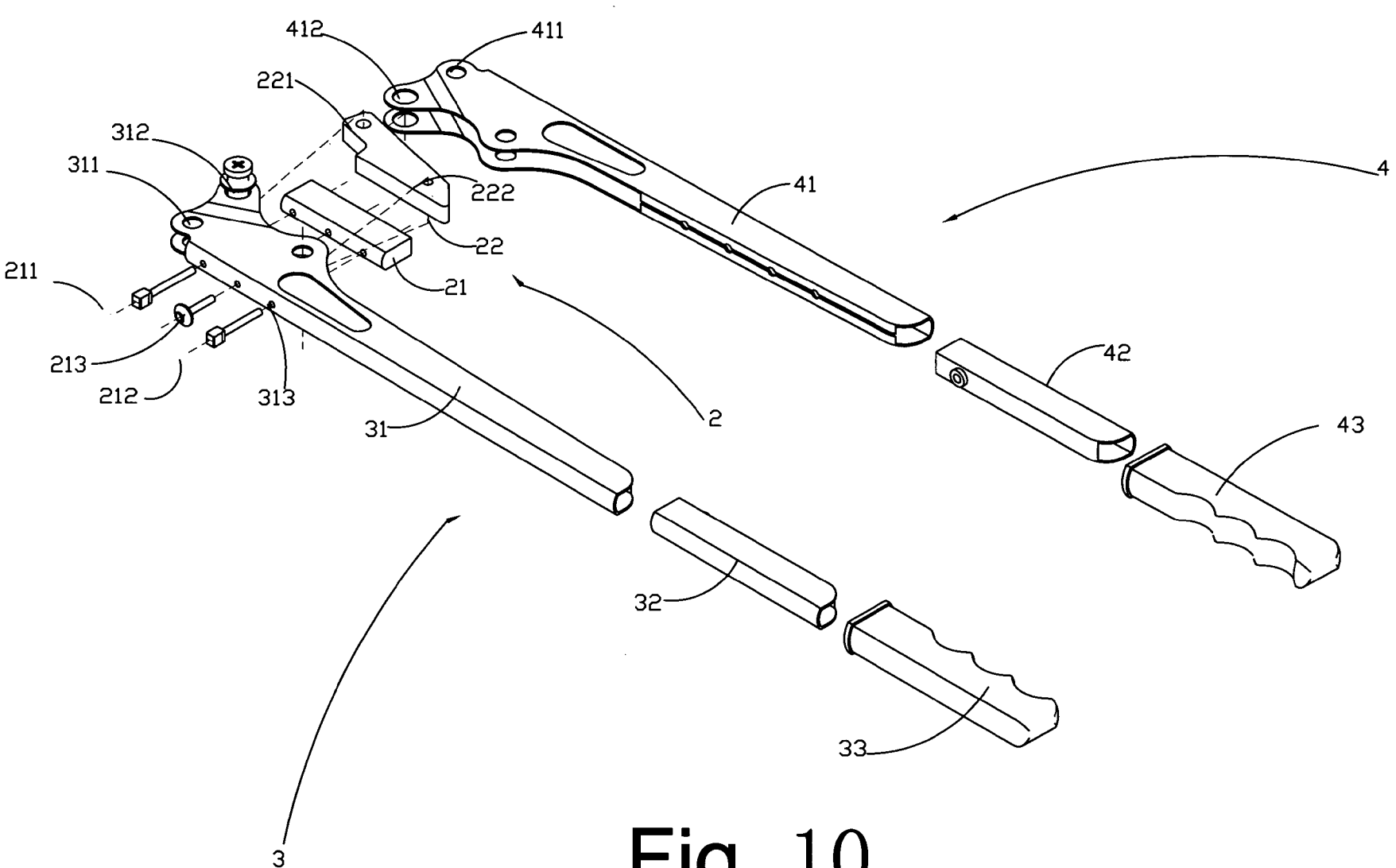
FIG. 10 is an exploded perspective view of the adjustable handles and adjusting unit according to the above preferred embodiment of the present invention.

Referring to FIGS. 1 and 10 of the drawings, the adjusting unit 2 comprises a locating block 21 and an adjusting block 22. As shown in FIG. 5, a plurality of through holes 313 is provided on the upper portion of the upper arm 31. In this embodiment, there are three through holes 313 provided at the outer side of the upper arm 31. The locating block 21 is disposed within the inner side channel of the upper arm 31 by the means of inserting a fastening screw into the middle screw hole 313 to engage with the locating block 21. In addition, the adjusting unit 2 further comprises an adjustment screw 211 and a fine adjustment screw 212 which are engaged with the locating block 21 for adjusting the location of the adjusting block 22, wherein the adjustment screw 211 and fine adjustment screw 212 pass through the corresponding through holes 313 and the locating block 21 respectively until they are against the adjusting block 22. There are at least two connecting holes 221, 222 formed on the adjusting block 22, while the upper end of the upper arm 31 has two sets of connecting holes 311, 312, and the upper end of the upper arm 41 has two sets of connecting holes 411, 412. The connecting hole 312 and the connecting hole 412 are different in size. The adjusting block 22 is connected with the upper arms 31, 41 by screws, that is, the screw first passing through the connecting hole 412, then being inserted into the connecting hole 221, finally passing through the connecting hole 312 in such manner the adjusting block 22, upper arms 31, 41 are operatively connected together. Moreover, insert another screw into the connecting hole 222 to fasten the other end of the adjusting block 22 to the inner side channel of the upper arm 31. Because the screw or pin will squeeze the connecting holes, such as connecting holes 311, 312, after such situation lasting for a period of time, the circular screw holes 311, 312, will be transformed into elliptical screw holes, or the like, which leads to an extra space left between the screws and the screw holes. As a consequence, the crimping jaws would not be easily and fittingly attached onto the heads for tightening up the sealing rings. As a result, the pipe ends would not be received within the pipe joints in a leak-proof manner. Therefore, we should adjust the adjustment screw 211 and fine adjustment screw 212 to assure the adjusting block 22 placed at another new position to compensate the worn-error exists between the crimping jaws 10, 11.

Referring to FIG. 1 of the drawings, the upper arms 31, 41 are pivotally connected to the heads 12, 13 respectively through screws being inserted into the screw holes 311, 411.

Moreover, there is at least one small recess 1110 painted with different color for identifying the specification of different crimping jaws disposed on the crimpling jaws 10, 11. The color of the small recess 1110 can be several types, such as red, blue, different color stands for different specification, such that the user can easily recognize the specification of crimping jaws.

Figure 11:
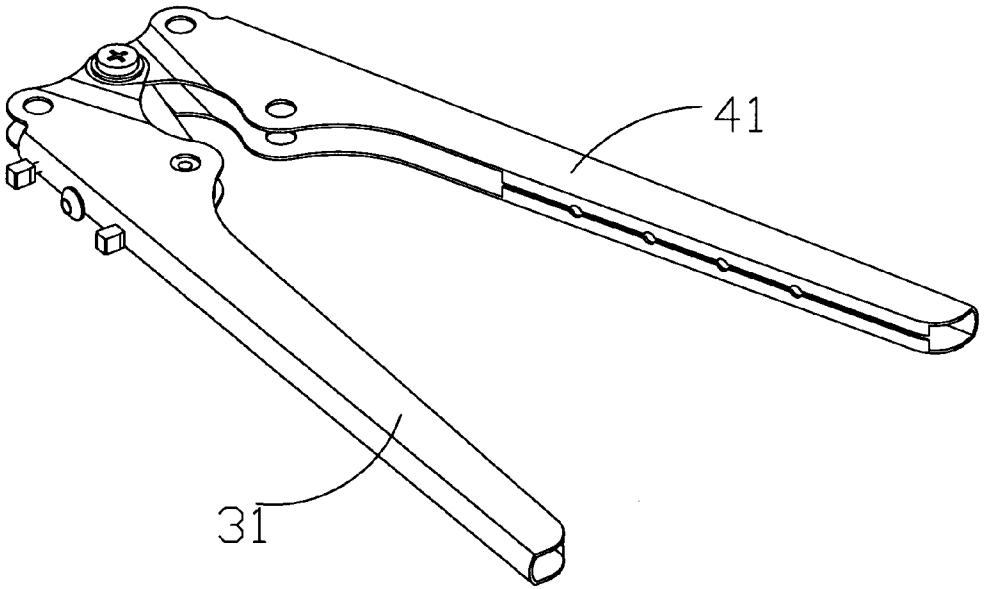
FIG. 11 is a perspective view of the upper arms manufactured by punching according to the above preferred embodiment of the present invention.
Figure 11:
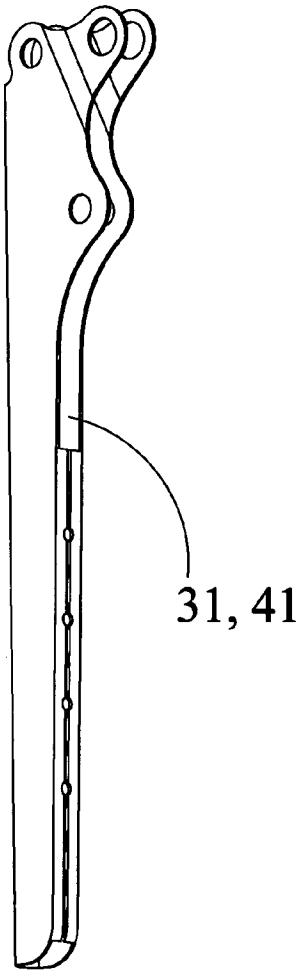
Figure 12:
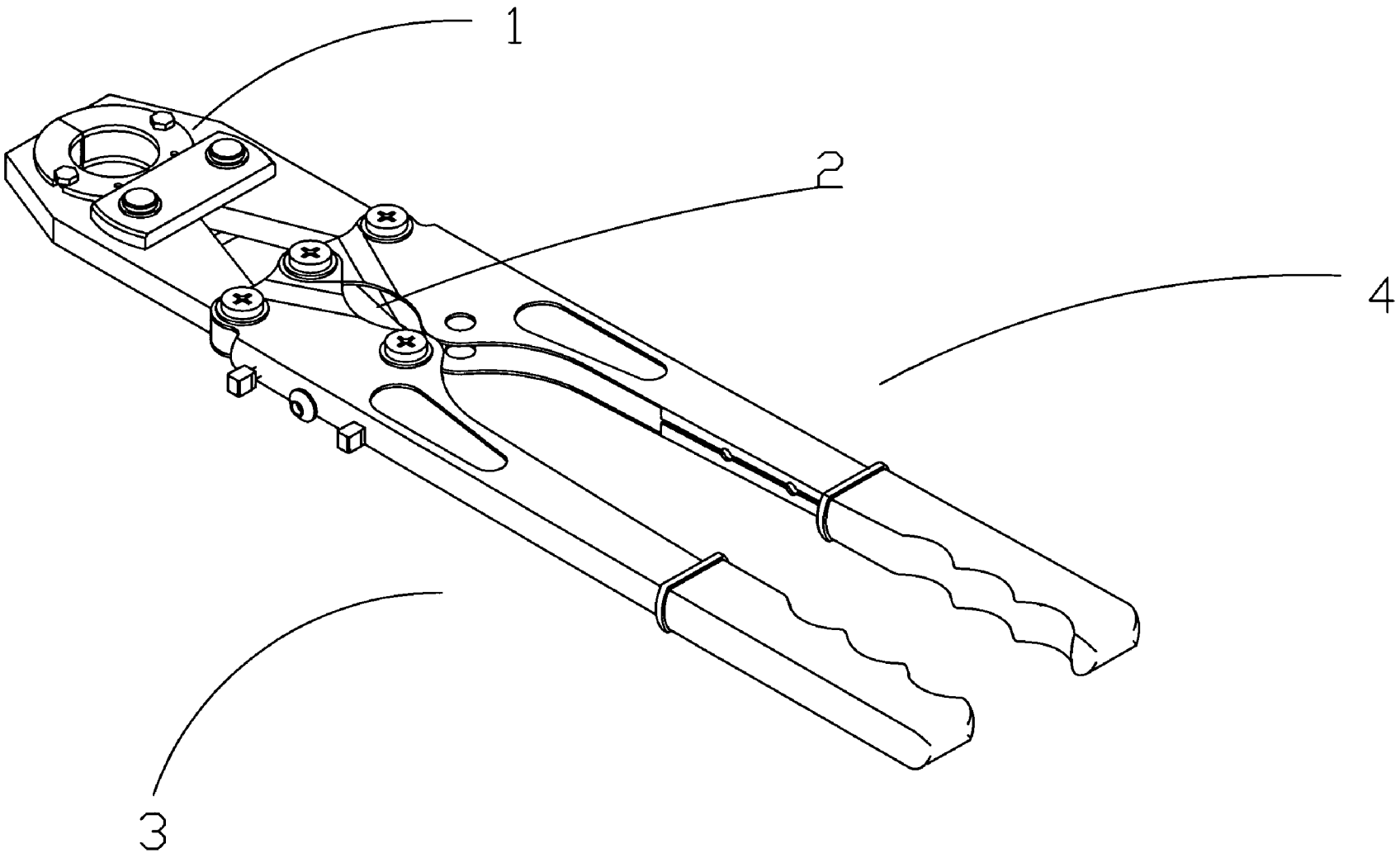
FIG. 12 is an assembled perspective view of the multi-functional crimping tool according to the above preferred embodiment of the present invention.

As shown in FIGS. 1 and 11, the upper arms 31, 41 can be manufactured by die-casting and punching, wherein the upper arms 31, 41 shown in the FIG. 1 manufactured by die-casting, while the upper arms 31, 41 shown in the FIG. 10 manufactured by punching.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multi-functional crimping tool for connecting pipe fittings with pipes, comprising:

a crimping head comprising a pair of crimping heads hinged together, wherein each of said crimping heads has a crimping head body, inwardly curved to form a semi-circular cavity, and a capped screw rotatably mounted onto a top side of the crimping head body at a position symmetrical with respect to other crimping head, said capped screw is shifted from a fastening position and a releasing position;

a pair of crimping jaws respectively received within the semi-circular cavities and operatively clipped onto said crimping heads respectively, wherein in said fastening position, said capped screw is screwed down to secure said crimping jaws tightly attached onto said crimping head, and in said releasing position, said capped screw is loosened up allowing said crimping jaws transversely pulled off said crimping head for replacement purposes; and a pair of crimping handles respectively and pivotally connected with said crimping head, and folded towards and away from each other so as to facilitate said two crimping head moved towards each other combining said two semi-circular cavities into a circular shaped cavity for accommodating said pipes, or moved away from each other for allowing said crimping jaws to be detachable from said crimping head, wherein each of said crimping jaws comprises a semi-circular shaped jaw body, a pair of jaw flanges rearwardly extended from said jaw body for forming a semi-circular channel to clip onto said crimping head, said crimping jaws has a positioning notch provided at an upper flange of said jaw body for inserting said capped screw.

2. The multi-functional crimping tool, as recited in claim 1, wherein said positioning notch is T-shaped in cross section, having a lower portion and an upper recessed terrace for fittingly perching a cap of said capped screw, wherein a dimension of said upper recessed terrace is slightly larger than a size of said cap of said capped screw, such that in said fastening position, said capped screw is capable of being supported by said upper recess terrace so as to prevent said crimping jaws from being laterally slipped off said capped screw.

3. The multi-functional crimping tool, as recited in claim 2, wherein said upper recessed terrace is hex-shaped for accommodating said cap of said capped screw.

4. The multi-functional crimping tool, as recited in claim 3, wherein each of said crimping handles comprises an elongated upper arm, and a lower sleeve slidably engaged with said upper arm for selectively managing a length of said crimping handles.

5. The multi-functional crimping tool, as recited in claim 2, wherein each of said crimping handles comprises an elongated upper arm, and a lower sleeve slidably engaged with said upper arm for selectively managing a length of said crimping handles.

6. The multi-functional crimping tool, as recited in claim 1, wherein each of said crimping jaws comprises a plurality of engaging teeth spacedly and evenly defined along a front protruding portion of said crimping jaws respectively so as to ensure said pair of crimping jaws tightly engaged with each other.

7. The multi-functional crimping tool, as recited in claim 6, wherein each of said crimping handles comprises an elongated upper arm, and a lower sleeve slidably engaged with said upper arm for selectively managing a length of said crimping handles.

8. The multi-functional crimping tool, as recited in claim 7, wherein said upper arm comprises an elongated shaped body having a longitudinal ridge inwardly tucked at a lower portion of said upper arm to form an elongated guiding channel, wherein a plurality of positioning cut-outs are spacedly and evenly provided onto both edges of said elongated guiding channels for forming a plurality of positioning slots.

9. The multi-functional crimping tool, as recited in claim 8, wherein each lower sleeve correspondingly shaped for inserting of said upper arm and having an opening at one end for fittingly inserting the lower portion of said upper arm, further comprises:

a length adjusting arrangement for selectively attaching said lower sleeve on said upper arm, comprising:

a protruding knob projected onto said lower sleeve body;

an adjusting shaft transversely penetrating said lower sleeve body, comprising a push end provided onto said protruding knob, a resilient end biasing against an inner wall of said lower sleeve body, and a positioning valve provided on said adjusting shaft at a predetermined position, wherein said length adjusting arrangement is operated with such a manner that when said push end is depressed, said positioning valve will be lower to a position below said edge of said guiding channel so as to allow said lower sleeve freely slide with respect to said upper arm until said adjusting shaft perched into one of said positioning slot of said guiding channel for achieving a desirable length of said crimping handle.

10. The multi-functional crimping tool, as recited in claim 8, further comprising an adjusting unit operatively connected to one of said crimping handles for compensating a worn-error between said screws and said screw holes wherein the adjusting unit comprises a locating block disposed within one of said crimping handles, and an adjusting block pivotally connected to both crimping handles.

11. The multi-functional crimping tool, as recited in claim 7, wherein each lower sleeve correspondingly shaped for inserting of said upper arm and having an opening at one end for fittingly inserting the lower portion of said upper arm, further comprises:

a length adjusting arrangement for selectively attaching said lower sleeve on said upper arm, comprising:

a protruding knob projected onto said lower sleeve body;

an adjusting shaft transversely penetrating said lower sleeve body, comprising a push end provided onto said protruding knob, a resilient end biasing against an inner wall of said lower sleeve body, and a positioning valve provided on said adjusting shaft at a predetermined position, wherein said length adjusting arrangement is operated with such a manner that when said push end is depressed, said positioning valve will be lower to a position below said edge of said guiding channel so as to allow said lower sleeve freely slide with respect to said upper arm until said adjusting shaft perched into one of said positioning slot of said guiding channel for achieving a desirable length of said crimping handle.

12. The multi-functional crimping tool, as recited in claim 7, further comprising an adjusting unit operatively connected to one of said crimping handles for compensating a worn-error between said screws and said screw holes, wherein the adjusting unit comprises a locating block disposed within one of said crimping handles, and an adjusting block pivotally connected to both crimping handles.

13. The multi-functional crimping tool, as recited in claim 1, wherein each of said crimping handles comprises an elongated upper arm, and a lower sleeve slidably engaged with said upper arm for selectively managing a length of said crimping handles.

14. The multi-functional crimping tool, as recited in claim 13, wherein said upper arm comprises an elongated shaped body having two longitudinal ridge inwardly tucked at a lower portion of said upper arm to form an elongated guiding channel, wherein a plurality of positioning cut-outs are spacedly and evenly provided onto both edges of said elongated guiding channels for forming a plurality of positioning slots.

15. A multi-functional crimping tool for connecting pipe fittings with pipes, comprising:

a crimping head comprising a pair of crimping heads hinged together, wherein each of said crimping heads has a crimping head body, inwardly curved to form a semi-circular cavity, and a capped screw rotatably mounted onto a top side of the crimping head body at a position symmetrical with respect to other crimping head, said capped screw is shifted from a fastening position and a releasing position;

a pair of crimping jaws respectively received within the semi-circular cavities and operatively clipped onto said crimping heads respectively, wherein in said fastening position, said capped screw is screwed down to secure said crimping jaws tightly attached onto said crimping head, and in said releasing position, said capped screw is loosened up allowing said crimping jaws transversely pulled off said crimping head for replacement purposes; and a pair of crimping handles respectively and pivotally connected with said crimping head, and folded towards and away from each other so as to facilitate said two crimping head moved towards each other combining said two semi-circular cavities into a circular shaped cavity for accommodating said pipes, or moved away from each other for allowing said crimping jaws to be detachable from said crimping head, wherein each of said crimping jaws comprises a plurality of engaging teeth spacedly and evenly defined along a front protruding portion of said crimping jaws respectively so as to ensure said pair of crimping jaws tightly engaged with each other.

* * * * *